United States Patent [19]

Kleid et al.

[11] 4,014,535

[45] Mar. 29, 1977

[54] CONTINUOUS SHEET COLLATING METHOD AND APPARATUS

[75] Inventors: Robert E. Kleid, Fairfield; Donald J. Illk, Stamford; Ferris Gene Keyt, Trumbull, all of Conn.

[73] Assignee: Pitney-Bowes, Inc., Stamford, Conn.

[22] Filed: May 25, 1976

[21] Appl. No.: 689,956

Related U.S. Application Data

[63] Continuation of Ser. No. 585,849, June 11, 1975, abandoned.

[52] U.S. Cl. ..... 270/19; 270/21; 270/60

[51] Int. Cl.[2] ..... B41F 13/64

[58] Field of Search ..... 270/6, 10, 13, 19, 38, 270/42, 60, 47–50; 83/913, 54, 924, 337, 388; 101/224–228

[56] References Cited

UNITED STATES PATENTS

| | | | |
|---|---|---|---|
| 808,578 | 12/1905 | Rottinger | 83/924 X |
| 2,335,431 | 11/1943 | Meyer | 270/47 |
| 3,146,649 | 9/1964 | Burger | 83/54 X |
| 3,163,066 | 12/1964 | Beaulieu | 83/924 X |
| 3,689,061 | 9/1972 | Nystrand | 270/69 |

*Primary Examiner*—Edgar S. Burr
*Assistant Examiner*—A. Heinz
*Attorney, Agent, or Firm*—William D. Soltow, Jr.; Albert W. Scribner; Robert S. Salzman

[57] ABSTRACT

A continuous sheet collating system is disclosed for printed texts wherein a continuous web of printed sheet-like material is continuously fed to a continuously, uninterrupted, collating drum. The web is wrapped upon the rotating drum a number of times equal to the number of printed sheets (less one) desired in a (text) collated stack of printed sheets. The wrapped web is then severed at the desired wrap number to provide collated individual sheets of the printed text in their proper sequential order. These sheets are then discharged from the collating drum as a unitized mass of collated printed sheets in textual context.

15 Claims, 6 Drawing Figures

CONTINUOUS SHEET COLLATING METHOD AND APPARATUS

This is a continuation of application Ser. No. 585,849 filed June 11, 1975, now abandoned.

The invention pertains to a collating method and apparatus, and more particularly to a continuous sheet collating system, that collates the sheet material while it is in a web.

BACKGROUND OF THE INVENTION

Heretofore, collating systems have operated on a start-and-stop basis. By this it is meant, that precut sheets of printed material are projected towards a collating table where they are brought to a stop, before they are moved forward as a collated stack of printed sheets. However, with the desire for higher sheet-handling speeds, these previous systems have been found to be inadequately slow. These systems became unreliable, when attempts were made to increase their operating speed primarily because of the dynamics of abruptly stopping the sheets and restarting the stacks. The present invention was conceived as a means of providing a high speed continuous collating operation.

SUMMARY OF THE INVENTION

The invention relates to a method and apparatus for continuously collating printed sheets of material, while the printed material is in a web. This novel approach to collating comprises a continuously, uninterrupted rotating collating drum that receives a web of printed sheet-like material. The web is continuously fed to the drum, and is wrapped around the rotating drum a number of times. The drum has a circumferential length substantially equal to a standard textual sheet width, or length e.g. 8½ inches or 11 inches. The web is severed into individual sheets by an adjacent electrically controlled rotating cylinder that supports a movable knife blade. The knife blade is maintained in a non-cutting position, while the web is wrapped about the collating drum. When the desired number of sheets (less one) is obtained upon the rotating, uninterrupted collating drum, the knife blade severs the web. One sheet width (or length) of web is then fed through the adjacent drums, and merges with the severed sheets on the collating drum as they are discharged. This provides the desired number of printed sheets in the proper text sequence (textual context). The last sheet from the web is severed as it joins the other sheets discharging from the collating drum.

A pressure roller disposed adjacent the collating drum provides a pressured bite for the web, so that it can be positively fed to the collating drum.

The collating drum has a plurality of vacuum ports arranged along its transverse axis for gripping each new leading edge of the web by vacuum pressure.

It is an object of this invention to provide an improved printed sheet collating method and apparatus for providing texts of printed material in their proper sequential (page by page) order;

It is another object of the invention to provide a continuous, uninterrupted collation of printed sheet material;

It is yet another object of this invention to provide a continuous printed sheet collating method and apparatus wherein the collation takes place while the printed material is still in the web.

These and other objects of the invention will be better understood and become more apparent with reference to the following detailed description taken in conjunction with the attached drawings, in which:

FIG. 1 is a perspective view of the collating apparatus of this invention; and

FIGS. 2*a* through 2*e* are schematic views of the inventive apparatus of FIG. 1, showing the sequence of operation.

DETAILED DESCRIPTION

Generally speaking, the invention is for a method and apparatus for continuously collating printed sheet material while the printed material is in a web. A continuous web of printed sheet-like material is continuously fed towards a continuously, uninterrupted, rotating collating drum. The web is wrapped upon the drum a number of times to provide at least one or more wraps of sheet. The wraps are then severed to provide a number of individual sheets (text pages) disposed upon the drum. A final length of web is cut and discharged and merges with the sheets upon the drum. All the sheets are then discharged from the collating drum as a unitized mass of collated printed sheets to form a completed bundle of printed material in textual context.

Figure 1:
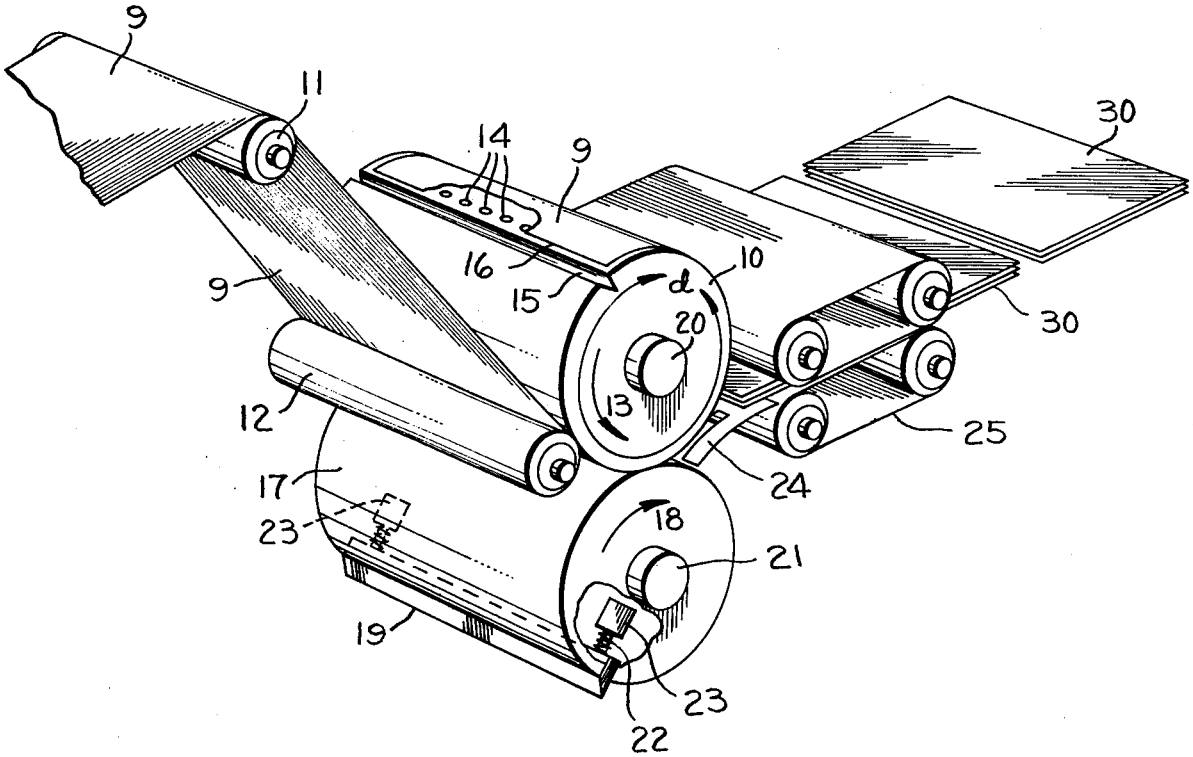

Now referring to FIG. 1, a perspective view of the inventive collating apparatus is illustrated. A web of sheet-like material 9 having printed text thereon, is shown being fed to a collating drum 10.

A feed path for the web 9, is defined by the feed roller 11 and a pressure roller 12. The roller 12 provides a pressured bite for the web 9, so that it will feed in a positive manner upon the collating drum 10. The pressured bite can be accomplished by spring loading the roller 12 against the drum 10.

The collating drum or cylinder 10 continuously rotates in a counterclockwise direction as shown by arrow 13. The drum 10 has a number of vacuum ports 14 disposed along the edge of a knife well 15. The ports 14 provide a vacuum pressure for engaging the leading edge 16 of the web 9 and holding the web upon the drum as the drum 10 rotates. The continuous and uninterrupted rotation of the drum causes the web to become wrapped about the circumference of the drum. Since the final objective of the invention is to provide stacks of collated printed sheet, the circumferential distance *d* of the drum is made equal to either a width or a length of a standard textual or printed sheet of 8½ inches × 11 inches. Of course, it will be realized that other standard sheet sizes will necessitate a different drum distance *d.*

A rotating severing cylinder or drum 17 is depicted adjacent the collating drum 10. The severing cylinder 17 rotates in an opposite direction to that of the collating drum as illustrated by arrow 18. Cylinder 17 carries a knife blade 19 which is designed to project into the knife well 15 on the collating drum 10. Naturally, it will be realized, that the rotation of the drum 10 and 17 must be synchronized in order for the knife blade 19 to always meet with well 15. This synchronization can be accomplished by a cross-over, sprocket chain drive (not shown) between the drum shafts 20 and 21, respectively, or by two meshing gears.

Drums 10 and 17 must be resilient or movably biased toward each other, in order to accommodate various quantities of wrap and thicknesses of sheet.

During the wrapping of the web 9 on drum 10, the knife blade 19 remains retracted within drum 17 so as not to cut into the web 9. When it is desired to provide a stack of collated sheets, the knife blade 19 is extended to cut the number of wraps of web disposed upon drum 10. This produces several individual sheets arranged in a unitized mass upon drum 10. The knife blade 19 is extended against the biasing of a spring 22 by means of a solenoid 23. Another means of moving the knife blade 19 may include a mechanical clutch or a pneumatic piston. The activation of solenoid 23 can be controlled by an optical sensor and/or an electronic counter which monitors the number of times the web 9 is wrapped about drum 10. Of course other suitable controls are obviously possible, but are of no patentable concern to the present invention.

When a stack 30 of sheets is discharged from drum 10, a guide plate 24 directs the stack 30 into the bite of a transparent mechanism or conveyor 25.

OPERATION OF THE INVENTION

Operation of the inventive apparatus will be explained with additional reference to FIGS. 2*a* through 2*e*. FIGS. 2*a* through 2*e* are sequential schematic views of the apparatus of FIG. 1.

Figure 2A:
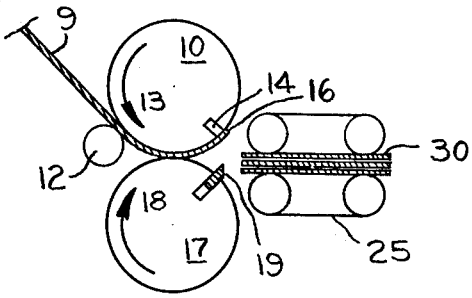

FIG. 2*a* depicts the beginning of a collating cycle. The printed web of sheet material 9 engages the drum 10 by entering the bite of the pressure roller 12 and drum 10. The leading edge 16 of the web 9 is held to the drum 10 by means of the vacuum ports 14. Simultaneously with the entrance of the web 9, is the discharging of a collated stack of sheets 30 to the transport mechanism 25.

The inventive process and system is continuous. There is no start-and-stop between cycles except to energize and deactivate the system at the beginning and end of the complete run (many cycles of operation). The web 9 continually feeds, and the drum 10 continuously rotates.

Figure 2B:
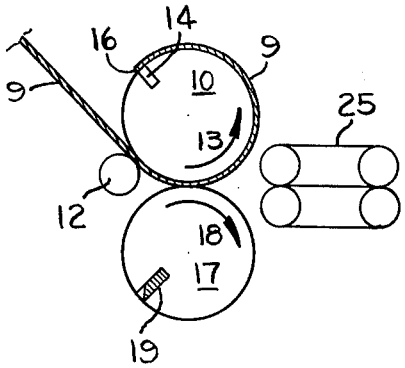

Once the web 9 is secured upon the drum 10, the rotation of the drum causes the web 9 to wrap about the drum 10 as illustrated in FIG. 2*b*.

Figure 2C:
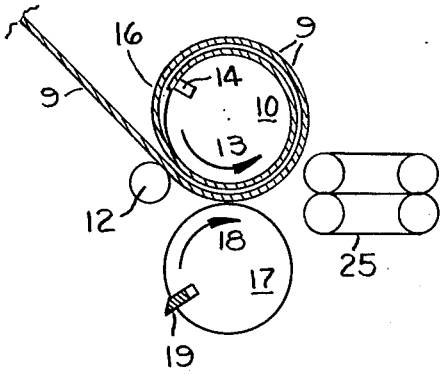
Figure 2D:
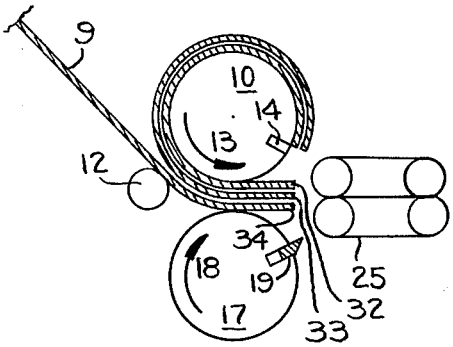
Figure 2E:
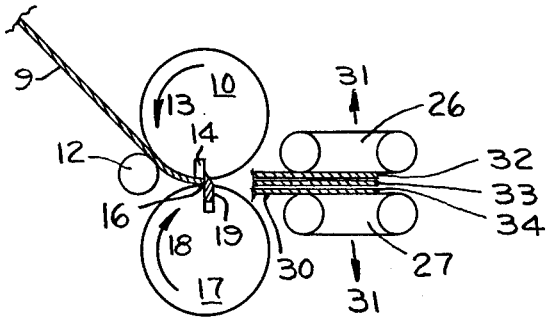

For a stack of three collated sheets (three was chosen only by way of example), the drum 10 rotates two complete revolutions. This provides two sheet lengths or widths to be taken up on the drum (FIG. 2*c*). At this point in time, the knife blade 19 is caused to extend outwardly from cylinder 17. The blade 19 cuts the wrapped web causing two sheets 32 and 33 to be discharged from the drum 10 towards the conveyor 25 as shown in FIG. 2*d*. The third sheet 34 of the stack is also discharged along with sheets 32 and 33. This third sheet 34 is not supplied by the drum 10, however, but is supplied directly from the web 9.

In other words, the numerical amount of printed sheets in any collated stack provided by this system, is equal to the number of wraps upon the drum, plus one; the final sheet being supplied directly from the web 9.

As the drum 10 continues to turn (FIG. 2*e*), the final stack 30 is obtained by cutting the final sheet 34 from the web 9. This second cut also serves another purpose. The system is now at the beginning of a new cycle, with the new leading edge 16 of the web 9 being formed by the second cut of blade 19. Thus, the system is ready to repeat cycles 2*a* through 2*e*. As can be readily seen, the new cycle is initiated without slowing up, or stopping any of the operative parts.

It will be realized that in order to discharge the stack 30, the vacuum ports 14 must of necessity release the inner sheet 32, before engaging with the new leading edge 16 of web 9.

The control of the vacuum port pressure can be tied-in with the operation of the knife blade solenoid 23. In other words, every activation of the solenoid 23 will cause a release of port vacuum pressure, and every deactivation will cause a reevacuation (vacuum) of the ports.

This is logical, because as the new cycle begins, the blade 19 must be retracted, while the vacuum pressure must also be reapplied through ports 14. Therefore, the same signal used to activate (deactivate) the knife blade solenoid can be used to initiate (deactuate) the vacuum port controls.

Naturally many modifications and changes can be made in the present invention consistent with good engineering practice. For example, mechanical grippers can be used to grip the leading edge 16 of the web instead of vacuum ports 14.

It should also be realized, that the circumferential distance *d* of drum 10 (FIG. 1), will be dependent upon the width or length of printed sheet in accordance with the direction in which the printed matter is disposed upon web 9. In other words, if the textual information is arranged transversely to the web travel, then the drum distance *d* must equal the length of the sheet.

It should also be evident, that there will occur in any particular run, different numbers of printed sheets per stack. In order to accommodate different thicknesses of sheet, and various numerical quantities of sheet, the drums 10 and 17 must be resilient or be able to move apart, as aforementioned.

Similarly, the decks 26 and 27 of the transport mechanism 25 (FIG. 2*e*) must also be able to separate (arrows 31) to accommodate quantitative or qualitative differences.

The full measure, scope and spirit of this invention is to be interpreted with reference to the appended claims, including all modifications that obviously occur to the skilled practitioner of this art.

What is claimed is:

1. A continuous sheet collating at least two discretely method for collating printed sheets which are initially printed on a web and subsequently cut from the web and collated, comprising the steps of:

a. feeding a continuous web of printed, sheet-like material towards a continuously, uninterrupted rotating collating drum;

b. wrapping said web around the continuously rotating collating drum a number of times which is one less than a desired number of sheets to be collated, to provide a number of wraps of printed sheet;

c. severing the wraps of printed sheet disposed upon the rotating collating drum to provide the desired number of individual printed sheets while the collating drum continues to rotate;

d. selectively controlling the severing of the wraps, whereby severing of the wraps takes place at any desired number of rotations of the collating drum;

e. supplying one additional printed sheet from the web of material, and collating said additional sheet together with the desired number of individual printed sheets from the collating drum; and f. discharging said number of individual printed sheets from said rotating collating drum and said additional printed sheet from the web, as a unitized mass of collated printed sheets to provide a bundle of printed sheets in textual context.

2. The continuous printed sheet collating method of claim 1, wherein the severing of the wraps of sheet further comprises the steps of:

g. maintaining a cutting means in a non-actuated, non-severing position while the web is being wrapped upon the rotating collating drum; and then h. selectively actuating the cutting means to cut the wraps of sheet.

3. The continuous printed sheet collating method of claim 1, wherein wrapping the web upon the rotating collating drum further comprises the steps of:

i. gripping a leading edge of the web upon said rotating collating drum; and j. simultaneously rotating the collating drum while gripping said web.

4. The continuous printed sheet collating method of claim 3, wherein the gripping of the web is accomplished by providing a vacuum upon a surface portion of the collating drum, and engaging the leading edge of the web upon the drum by vacuum pressure.

5. The continuous printed sheet collating method of claim 1, further comprising the step of:

k. transporting said unitized means of collated sheets away from the drum to provide a bundle of collated printed sheets in textual context.

6. A continuous printed sheet collating apparatus for collating at least two discretely printed sheets which are initially printed on a web and subsequently cut from the web and collated, comprising:

means defining a feed path for a continuous web of printed sheet-like material;

a continuously, uninterrupted rotating collating drum disposed along said feed path for receiving said web of printed sheet-like material, and means for wrapping said web around said drum to provide a number of wraps of sheet one less than a desired number of sheets to be collated;

severing means disposed adjacent said continuously rotating collating drum for severing the wraps of sheet while the drum continues to rotate, to provide the desired number of individual sheets disposed upon said collating drum;

means for supplying an additional printed sheet from the web of material;

selective control means operatively associated with the severing means for moving the severing means into, and out of, cutting engagement with the desired number of wraps of printed sheet disposed upon said continuously rotating collating drum; and means for collating said additional printed sheet with the severed wraps of printed sheet to provide a unitized collated bundle of printed sheets in textual context.

7. The continuous printed sheet collating apparatus of claim 6, further comprising gripping means supported by said collating drum for gripping a leading edge of said web for the purpose of wrapping said web upon the drum.

8. The continuous printed sheet collating apparatus of claim 7, wherein said gripping means comprises a plurality of vacuum ports disposed upon the drum for gripping the leading edge of the web by vacuum pressure.

9. The continuous printed sheet collating apparatus of claim 6, further comprising a pressure roller disposed adjacent said collating drum for providing a positive feed-in bite for the web, so that the web will be taken upon the collating drum.

10. The continuous printed sheet collating apparatus of claim 6, further comprising at least one pair of transport rollers disposed adjacent the collating drum for receiving discharged printed sheets from said drum and for transporting the discharged printed sheets away from the collating drum.

11. The continuous printed sheet collating apparatus of claim 6, wherein said severing means comprises a knife blade disposed upon a drum and operatively connected to said engaging means.

12. The continuous printed sheet collating apparatus of claim 11, wherein said severing drum rotates in a direction opposite to the rotating collating drum.

13. The continuous printed sheet collating apparatus of claim 11, wherein said severing drum operates in synchronism with said collating drum.

14. The continuous printed sheet collating apparatus of claim 6, wherein said collating drum has a circumferential length substantially equal to a printed page width.

15. The continuous printed sheet collating apparatus of claim 6, wherein said collating drum has a circumferential length substantially equal to a printed page length.

* * * * *

UNITED STATES PATENT AND TRADEMARK OFFICE

CERTIFICATE OF CORRECTION

PATENT NO. : 4,014,535

DATED : March 29, 1977

INVENTOR(S) : Robert E. Kleid, Donald J. Illk, Ferris Gene Keyt

It is certified that error appears in the above-identified patent and that said Letters Patent are hereby corrected as shown below:

IN THE ABSTRACT

Line 4 insert --rotating-- before "collating".

Figure 1 as shown on the title page, underneath the Abstract, should be turned rightside up.

Column 1, line 39 remove --moveable-- before "knife".

Column 4, Claim 1, lines 42 and 43 change "a continuous sheet collating at least two discretely method for collating printed sheets which are initially" to --A continuous sheet collating method for collating at least two discretely printed sheets--.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*